US008020633B2

(12) United States Patent
Buck et al.

(10) Patent No.: US 8,020,633 B2
(45) **Date of Patent: *Sep. 20, 2011**

(54) SIMULTANEOUS DRILLING AND OPEN HOLE WIRELINE LOGGING FOR DRILLING RIGS

(75) Inventors: George R. Buck, Midland, TX (US); Eric Roberto Upchurch, Long Beach, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/848,530

(22) Filed: Aug. 2, 2010

(65) Prior Publication Data

US 2011/0024109 A1 Feb. 3, 2011

Related U.S. Application Data

(63) Continuation of application No. 12/125,022, filed on May 21, 2008, now Pat. No. 7,836,974.

(60) Provisional application No. 60/940,210, filed on May 25, 2007.

(51) Int. Cl.
*E21B 47/00* (2006.01)

(52) U.S. Cl. ..... 175/40; 175/50

(58) Field of Classification Search ..... 175/40, 175/50; 166/254.2

See application file for complete search history.

(56) References Cited

U.S. PATENT DOCUMENTS

| | | | |
|---|---|---|---|
| 4,574,884 | A | 3/1986 | Schmidt |
| 5,839,520 | A | 11/1998 | Maillet |
| 2006/0144619 | A1 | 7/2006 | Storm, Jr. et al. |
| 2006/0151181 | A1 | 7/2006 | Shahin |
| 2006/0220651 | A1 | 10/2006 | Clark |

OTHER PUBLICATIONS

International Search Report from PCT/US08/06514 mailed Sep. 12, 2008.

*Primary Examiner* — William P Neuder
(74) *Attorney, Agent, or Firm* — Merchant & Gould

(57) ABSTRACT

A method of logging a wellbore comprises drilling a first wellbore to a depth using a drilling rig and drilling a second wellbore to a depth using the drilling rig. While the second wellbore is being drilled a logging operation is conducted in the first wellbore using the drilling rig. The logging operation can be conducted in the first wellbore via a wireline logging tool.

15 Claims, 8 Drawing Sheets

SIMULTANEOUS DRILLING AND OPEN HOLE WIRELINE LOGGING FOR DRILLING RIGS

CROSS-REFERENCE TO RELATED APPLICATIONS

The present application is a continuation application of U.S. patent application No. 12/125,022, filed May 21, 2008, which claims priority to U.S. Provisional Application No. 60/940,210, filed May 25, 2007.

BACKGROUND

1. Field

The presently disclosed method relates to the conducting of logging operations in wellbores, and more particularly to conducting open-hole wireline logging operations from a drilling rig that is simultaneously being used to conduct drilling operations in one or more wellbores adjacent to the logged wellbore(s).

2. Background of the Related Art

A detailed record, or log, of geologic formations penetrated by a wellbore is often made during logging operations. Such logs can be based on physical measurements made by instruments lowered into a borehole. Rock and fluid properties can be recorded to locate and quantify the depth of zones potentially containing hydrocarbons. A logging operation can consist of lowering a logging tool on the end of a wireline into an oil well (or hole) to make downhole measurements.

Presently, it is impossible to use a single drilling rig to obtain open-hole logs from one wellbore while simultaneously drilling another wellbore. The drilling operation must be halted to allow the open-hole logging operation to be performed which, in turn, requires additional rig time. What is needed is a method of logging a wellbore during a drilling operation in another wellbore that does not require halting on-going drilling operations, thus saving time.

SUMMARY

The presently disclosed method addresses the problem of obtaining logs—particularly wireline logs in open wellbores (also referred to as "open holes")—from one wellbore during a drilling operation in another wellbore without utilizing additional rig time. This permits wireline logging operations to proceed from a drilling rig in one wellbore while the drilling rig is used simultaneously to conduct drilling operations for another wellbore. As a result, the rig time to drill a wellbore is reduced and, in turn, the cost to drill a wellbore is also reduced.

Provided is a method of logging a wellbore. The method comprises drilling a first wellbore to a depth using a drilling rig; then drilling a second wellbore to a depth using the drilling rig, while simultaneously conducting a logging operation in the first wellbore using the drilling rig.

Also provided is a method of logging a wellbore comprising drilling a first wellbore to a first depth using a drilling rig; then drilling a second wellbore to a first depth using the drilling rig, while simultaneously conducting a logging operation in the first depth of the first wellbore using the drilling rig; then drilling the first wellbore to a second depth using the drilling rig; and then drilling the second wellbore to a second depth using the drilling rig.

DETAILED DESCRIPTION

Figure 1:
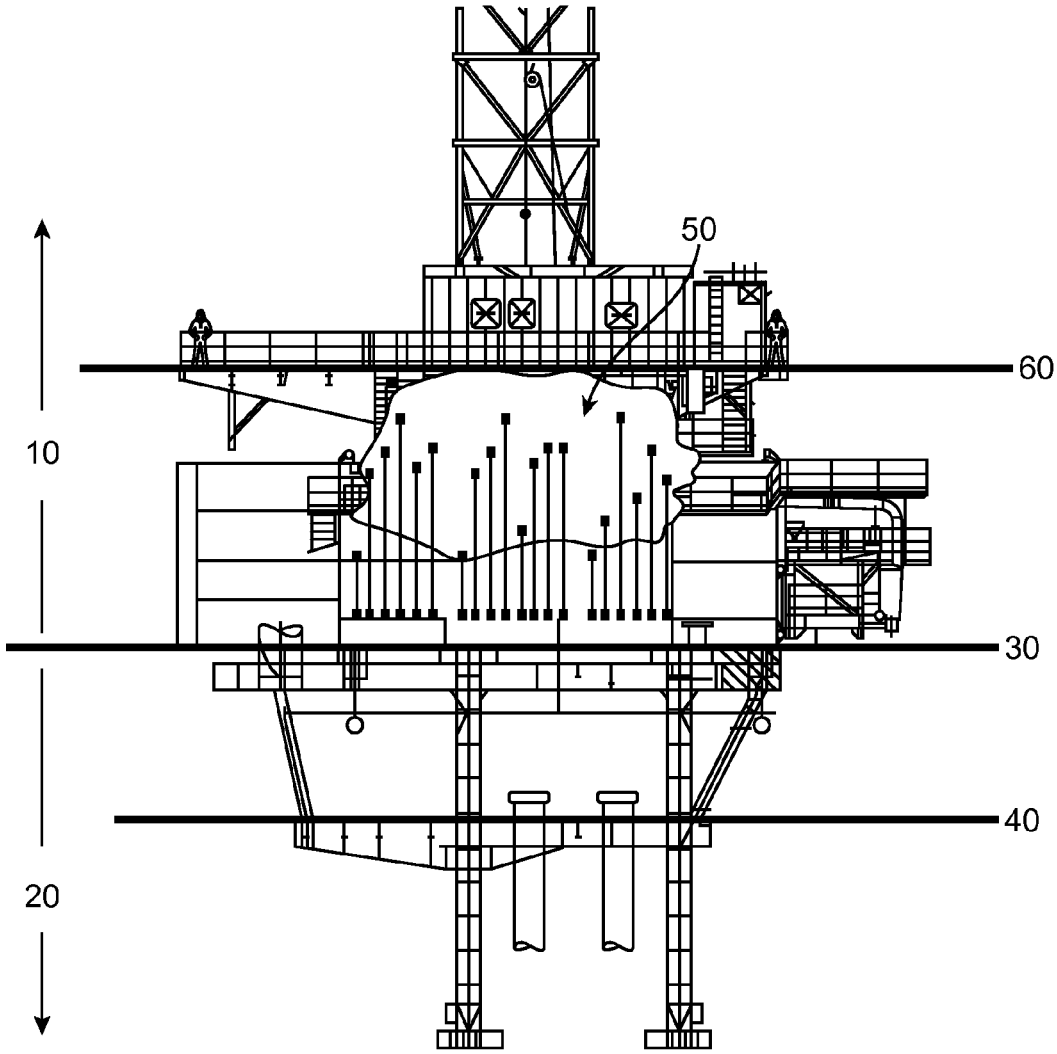
FIG. 1 is a side-view depicting a rig atop a platform and the relative lengths of various open hole logging tools.

The presently disclosed method allows open-hole logging to be accomplished in one or more wellbores in parallel with other operations, e.g., drilling, in other wellbore(s) from a common drilling rig. The presently disclosed method reduces the amount of time required to drill a wellbore by eliminating the prior necessity of suspending drilling operations to conduct open hole wireline logging.

Broadly stated, the presently disclosed method of logging a wellbore comprises the steps of drilling a first wellbore to a depth using a drilling rig; drilling a second wellbore to a depth using the drilling rig; and, while the second wellbore is being drilled, conducting a logging operation in the first wellbore using the drilling rig. In an embodiment, the logging operation can be conducted in the first wellbore via a wireline logging tool.

The presently disclosed method relates to a technique known as "batch drilling" wherein one or more (a "batch") of wellbores are sequentially drilled to a first casing depth (e.g., 1000 feet), and each of these wells are then "cased," followed by sequentially drilling each wellbore in the batch to a second depth (perhaps the top of a "pay zone") and then casing each wellbore between the first and second depths, and so on. A benefit of such batch drilling is that similar sections of adjacent wellbores can be drilled at the same (or nearly the same) time in assembly-line fashion so as to efficiently utilize the tools and processes that are specific to those wellbore sections (e.g., subsurface properties at a given depth interval). The presently disclosed method utilizes batch drilling techniques to further save drilling time and costs. In this manner, a number of wellbores can be logged while other wellbores are being drilled.

Accordingly, the presently disclosed method can further comprise casing a first wellbore after drilling a second wellbore. The depth of the first wellbore can be the same as the depth of the second wellbore. The presently disclosed method can further comprise drilling a third wellbore to a depth using the drilling rig. While the third wellbore is being drilled, a logging operation can be conducted in the second wellbore using the drilling rig. The logging operations can be conducted in all wellbores via a wireline logging tool. The first wellbore can be cased after drilling the second wellbore and before drilling the third wellbore, and the second wellbore can be cased after drilling the third wellbore.

In an embodiment, a method of logging a wellbore comprises the steps of: drilling a first wellbore to a first depth using a drilling rig; drilling a second wellbore to a first depth using the drilling rig; conducting a logging operation in the first depth of the first wellbore from the drilling rig while the first depth of the second wellbore is being drilled; drilling the first wellbore to a second depth using the drilling rig; and drilling the second wellbore to a second depth using the drilling rig.

The logging operations can be conducted in the first wellbore via a wireline logging tool. The logging operation can comprise an open-hole logging operation. The method can further comprise casing the first wellbore to the first depth after drilling the second wellbore to the first depth and before drilling the first wellbore to a second depth and casing the second wellbore to the first depth after casing the first wellbore to the first depth and before drilling the first wellbore to a second depth. The first depth of the first wellbore can be the same as the first depth of the second wellbore. The second depth of the first wellbore can be the same as the second depth of the second wellbore. The method can further comprise casing the first wellbore to the second depth after drilling the second wellbore to the second depth and casing the second wellbore to the second depth after casing the first wellbore to the second depth. The method can further comprise conducting a logging operation in the second depth of the first wellbore from the drilling rig while the second depth of the second wellbore is being drilled with the same rig, for example, with the logging operations conducted in the first wellbore via a wireline logging tool, and/or conducting a logging operation in the second depth of the first wellbore from the drilling rig while the second depth of the second wellbore is being drilled with the same rig, for example, with the logging operations conducted in all wellbores via a wireline logging tool.

The presently disclosed method allows wireline open hole logging to be taken out of the critical path of drilling rig operations. A basic procedure can include, for example: (1) drilling production hole section of Well A; (2) skidding rig to drill production hole section of Well B; (3) logging Well A off line while Well B is being drilled; (4) finishing drilling Well B production hole; (5) skidding rig to Well A to run and cement tubing or casing; (6) skidding rig to Well C to drill production hole section; (7) logging Well B off line while Well C is being drilled; (8) finishing drilling Well C production hole; (9) skidding rig to Well B to run and cement tubing or casing; etc.

FIG. 1 is a side-view depicting a rig 10 atop a platform 20. The rig 10 and platform 20 are separated by a BOP deck 30. Beneath the BOP deck 30, in the area of the platform 20, is a wellhead deck 40. Also illustrated are lengths of various open hole logging tools 50 that are all of lengths shorter than the vertical distance between the rig floor 60 and the BOP deck 30. This allows the open hole logging tools to be maneuvered as necessary between the rig floor 60 and the BOP deck 30.

Figure 2:
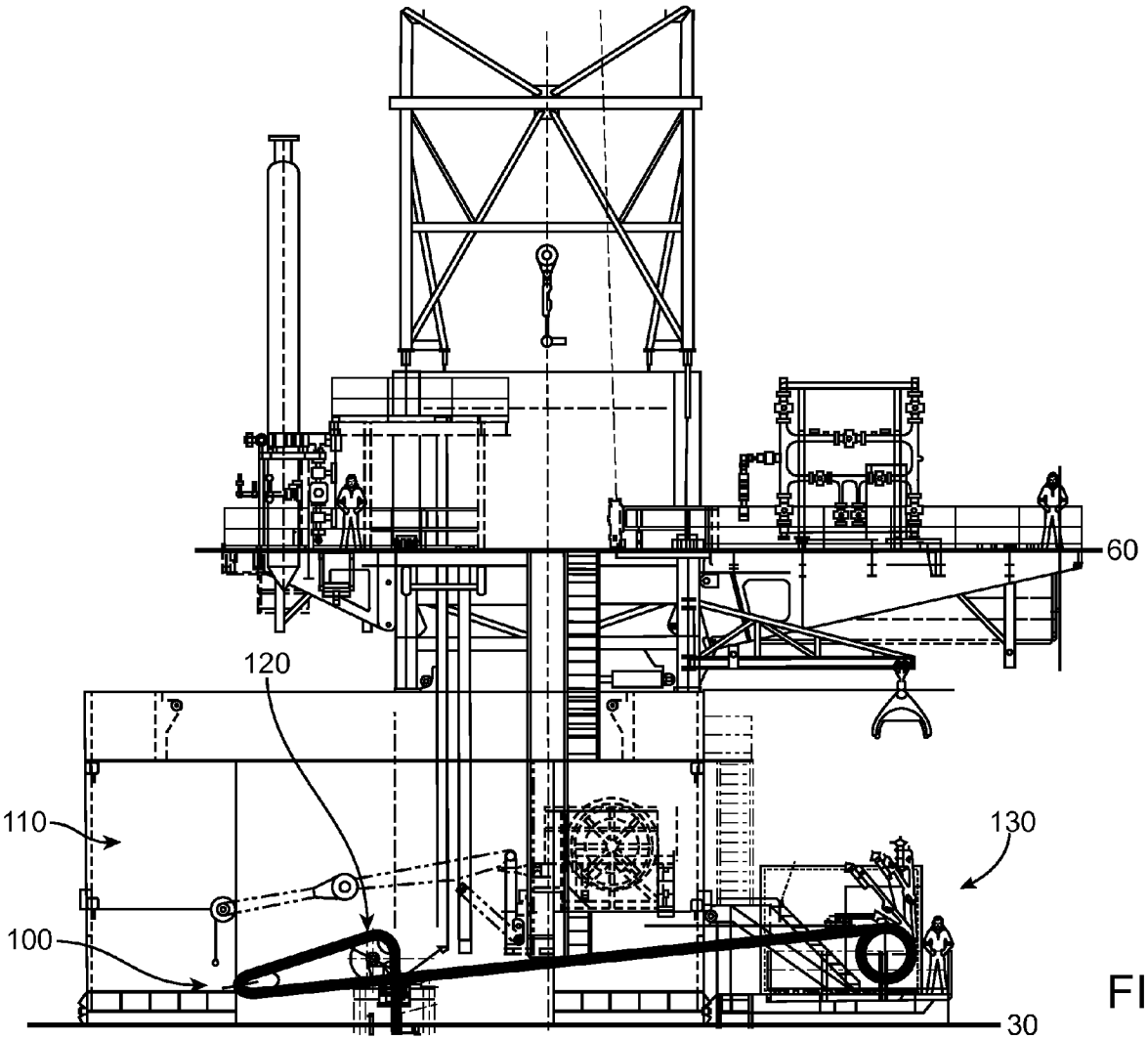
FIG. 2 is a side-view depicting a detailed view of a rig when performing logging under the rig floor.

FIG. 2 is a side-view depicting a more detailed view of the rig. In particular, the rig includes a diverter sheave 100, a master skid 110, an A-frame swivel sheave 120, and an under-rig-floor (URF) logging cantilever 130 that is connected to the master skid 110. FIG. 2 depicts the rig floor 60 portion of the drilling rig skidded over to a location for the drilling of a next production hole and starting URF logging operations on a previously drilled production hole.

Figure 3:
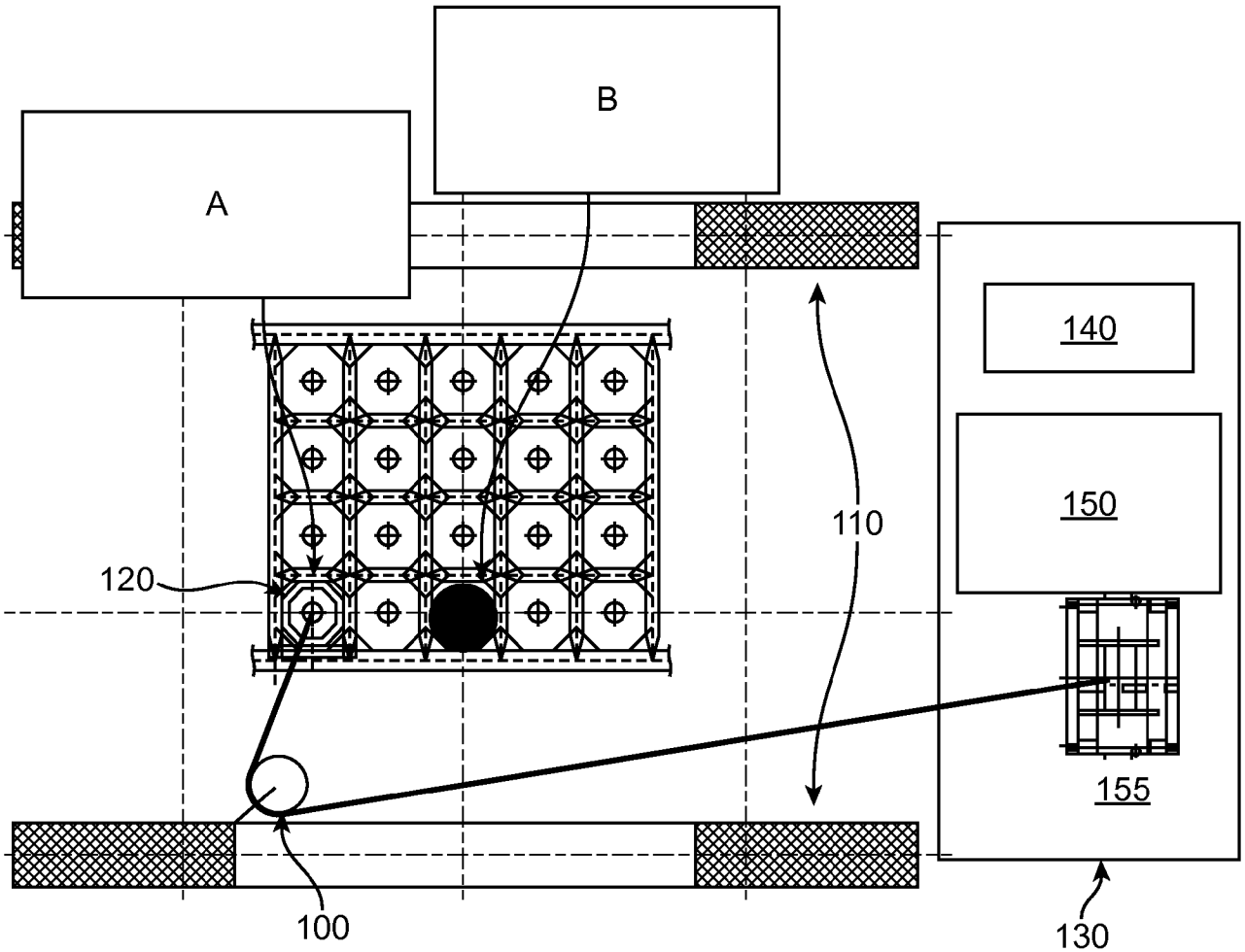
FIG. 3 is a top-view of a rig/platform interface at the Blow Out Preventor (BOP) deck level.

FIG. 3 is a top-view of the rig/platform interface at the BOP deck 30 level, depicting the diverter sheave 100, the master skid 110, the A-frame swivel sheave 120, and the URF logging cantilever 130. The URF logging cantilever 130 includes a power pack 140, control unit 150, and wireline winch 155. Identifier A in FIG. 3 represents the location of logging of a previously drilled production hole, while identifier B in FIG. 3 represents the location of drilling of the next production hole.

Figure 4:
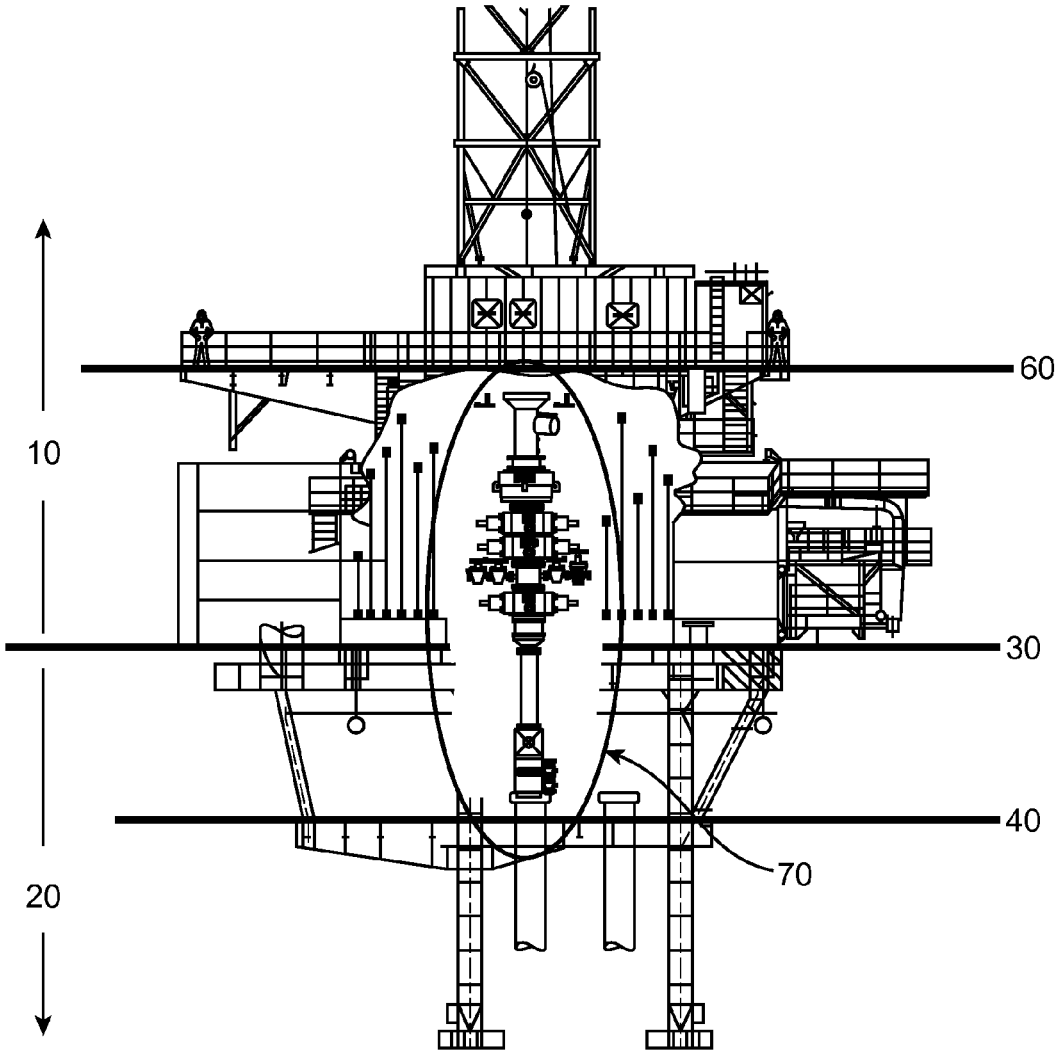
FIG. 4 is a side-view depicting a rig atop a platform and the relative position of pressure control equipment for drilling a hole.
Figure 5:
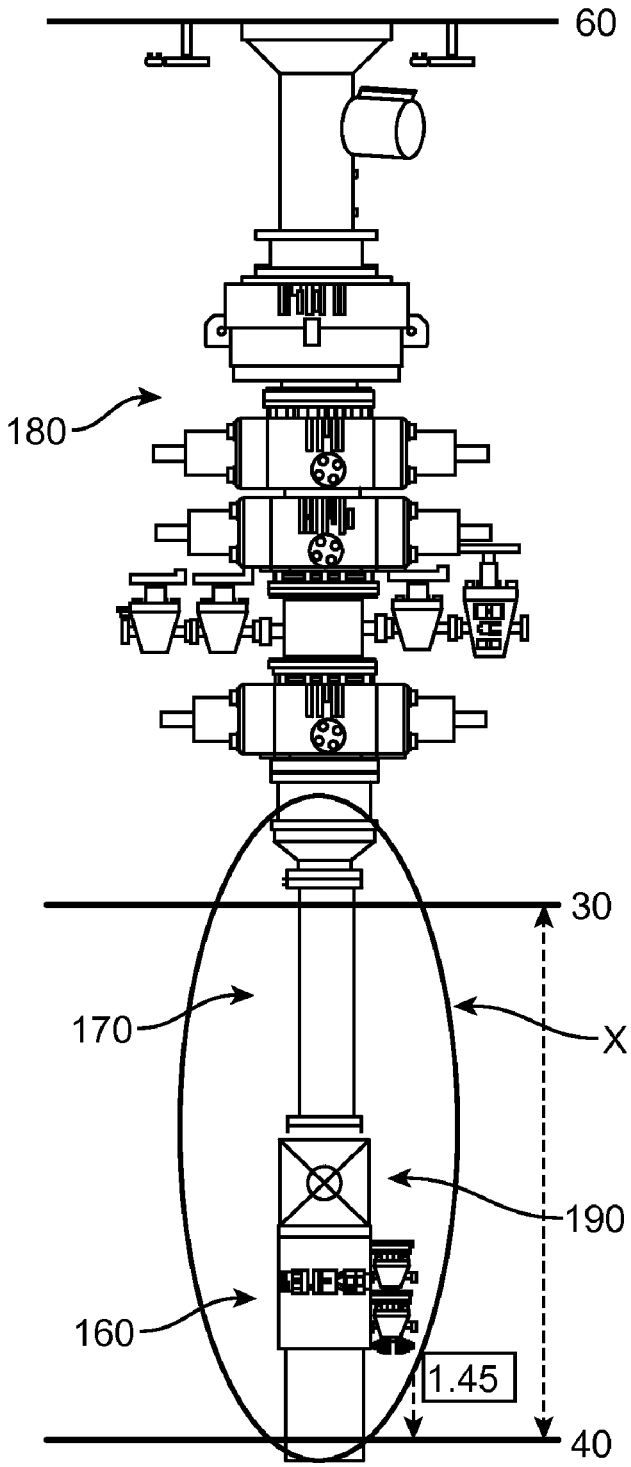
FIG. 5 is a detailed view of pressure control equipment for drilling a hole.
Figure 6:
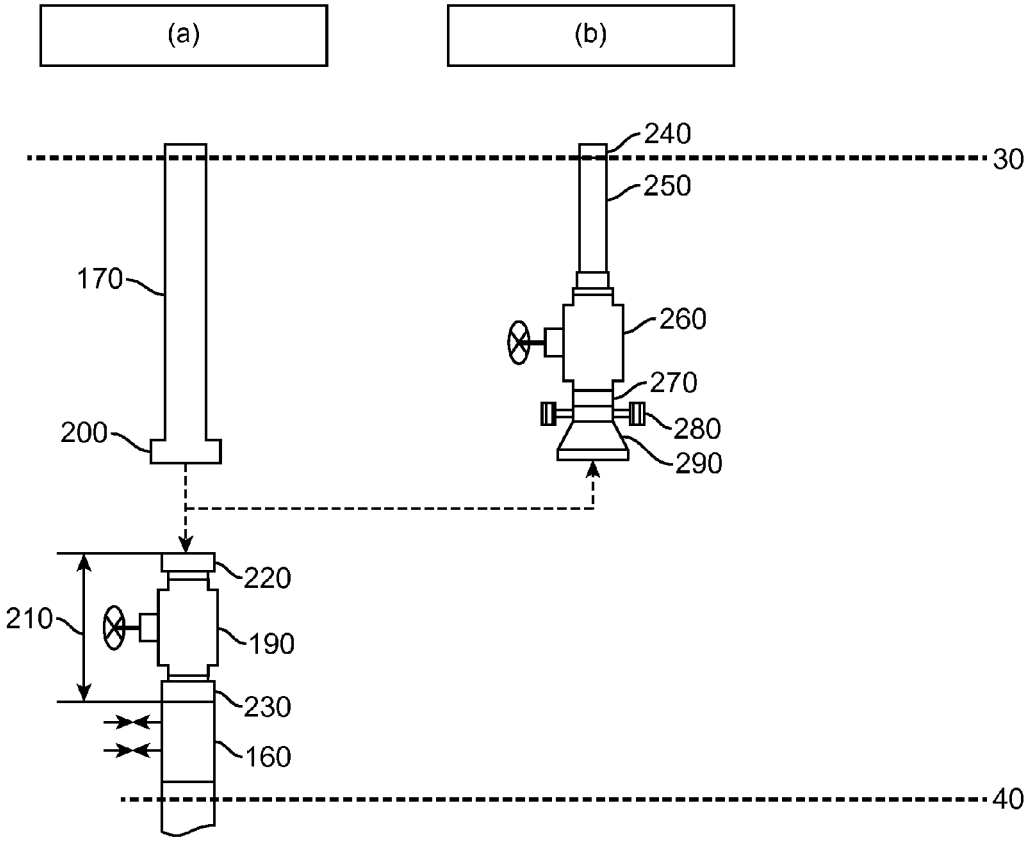
FIG. 6 depicts differences in pressure control equipment between a drilling mode and a logging mode.

FIG. 4 is a side-view depicting the rig 10, the platform 20, the BOP deck 30, the wellhead deck 40, and the rig floor 60, as well as the pressure control equipment 70 rig-up while drilling a hole (e.g., a 6⅛" hole). A more detailed view of the pressure control equipment rig-up is depicted in FIG. 5. The rig-up includes a wellhead 160, a drilling riser (e.g., a 5000 psi riser) 170, drilling BOPs 180, and a ball valve (e.g., 12" ball valve) 190. Identifier X in FIG. 5 represents the area shown in FIG. 6, which depicts differences in equipment between a drilling mode (a) and a logging mode (b).

For example, while drilling (a), drilling BOPs are located above the BOP deck 30, but while logging (b), an A-frame swivel sheave 120 can be located above, and attached to, the BOP deck 30. While drilling (a), a connection (e.g., a drive lock; not shown) can join the drilling BOPs above the BOP deck 30 to the drilling riser 170. Additional connections (e.g., drive locks) 200, 220 can join the drilling riser 170 to a ball valve (e.g., 12" ball valve; temp shut in BOP) 190, which can be joined to the wellhead 160 by means of a flange (e.g., a 12" welded neck D-flange) 230. The ball valve 190, connection 220, and flange 230 make up a temp BOP assembly 210. While logging (b), the A-frame swivel sheave 120 can be attached to the BOP deck 30 and positioned above a wireline pack off 240, which can be joined to a spool 250 which can be joined to a ball valve (e.g., a 10" ball valve complete with a double acting actuator) 260, which can be joined to a wireline cutter 270. Following the wireline cutter 270 can be a spool (e.g., complete with two side outlets) 280 and a connection 290 (e.g., a drive lock) to the temp BOP assembly 210 and wellhead 160, described above.

Figure 7A:
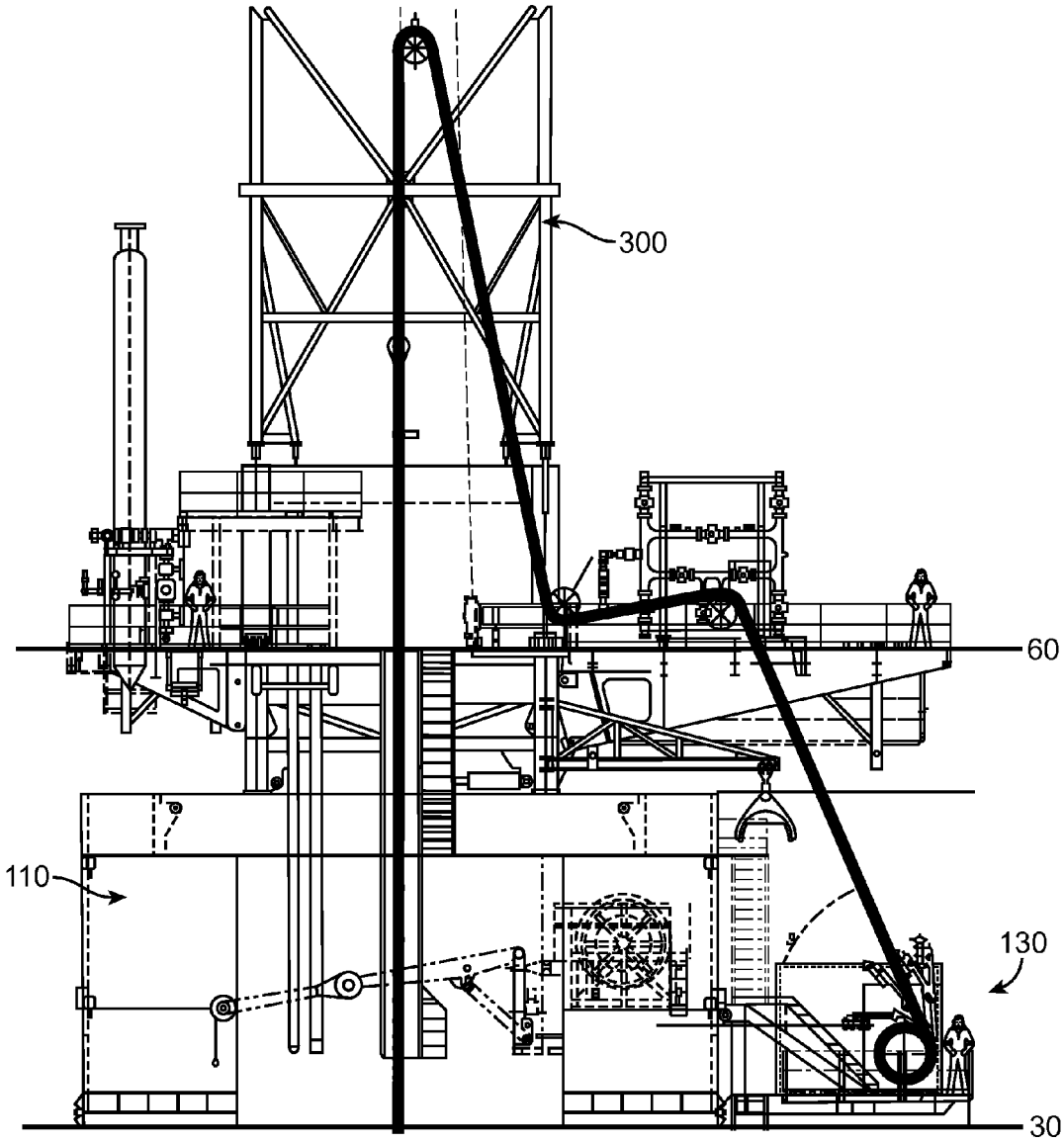
FIGS. 7*a* and 7*b* are side-views depicting detailed views of the rig when performing logging on the rig floor.
Figure 7B:
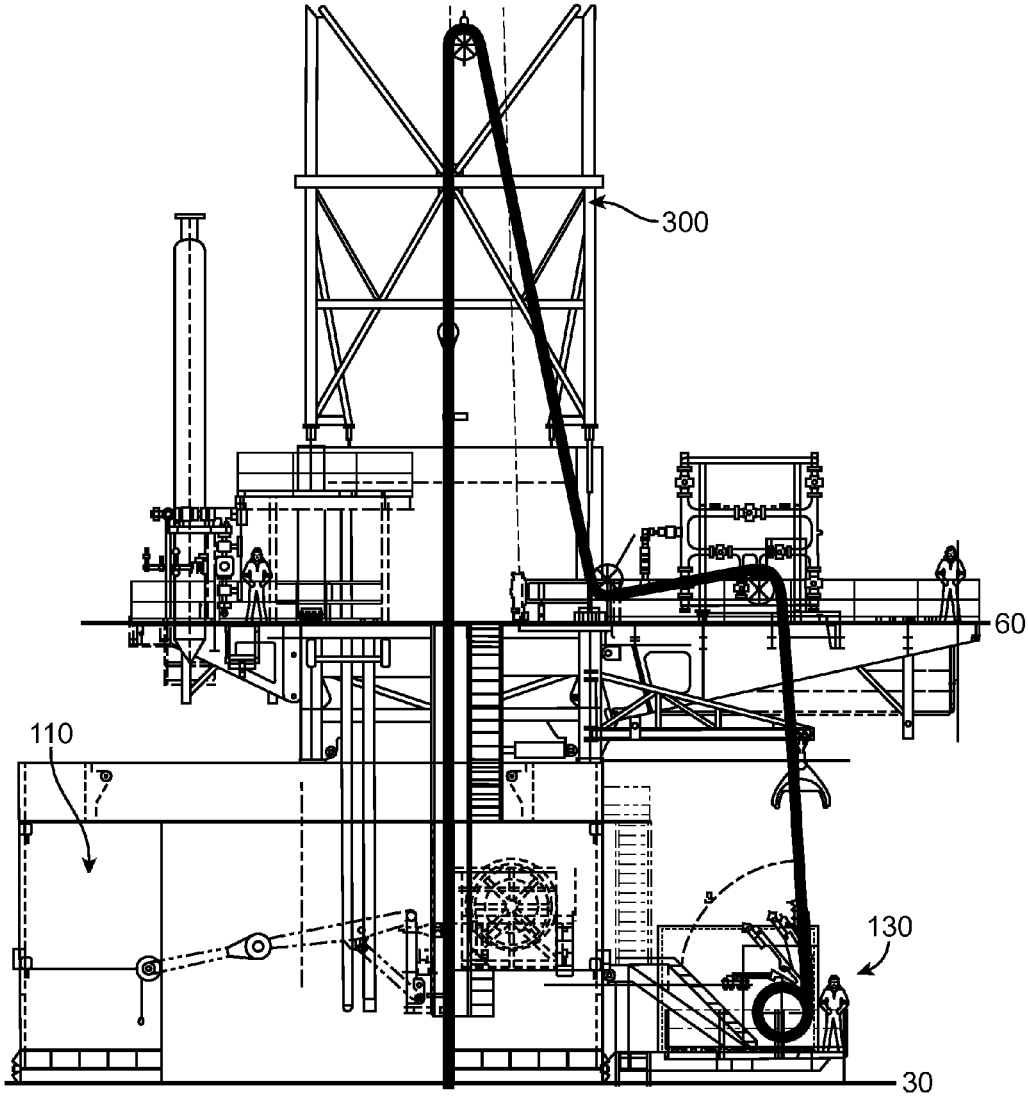

If URF logging is undesirable due to well control concerns, then logging can be conducted on the rig floor 60 immediately after drilling the hole section and immediately before running tubing (i.e., casing). FIG. 7 is a side-view depicting a more detailed view of the rig during a logging operation on the rig floor 60. In this particular situation, the wireline cable is routed from the wireline winch 155 on the URF logging cantilever 130, up to the rig floor 60, then up into the derrick 300, and finally down into the wellbore. FIG. 7*a* and FIG. 7*b* differ in the location of the wellbore being logged.

It will be understood from the foregoing description that various modifications and changes can be made in the embodiments of the presently disclosed method without departing from its true spirit. For example, the presently disclosed method can be expressed in a number of different embodiments and will have applications in many configurations of drilling rigs and wellbore bays, both onshore and offshore.

This description is intended for purposes of illustration only and should not be construed in a limiting sense. The scope of presently disclosed method should be determined only by the language of the claims that follow.

What is claimed is:

1. A method of logging a wellbore, wherein the logging comprises an under-rig-floor open-hole logging operation, the method comprising the steps of:

(a) drilling a first wellbore to a depth using a drilling rig;

(b) drilling a second wellbore to a depth using the drilling rig;

(c) while the second wellbore is being drilled, logging the first wellbore using the drilling rig.

2. The method of claim 1, wherein the logging of the first wellbore is conducted via a wireline logging tool.

3. The method of claim 1, further comprising drilling a third wellbore to a depth using the drilling rig.

4. The method of claim 3, further comprising, while the third wellbore is being drilled, logging the second wellbore using the drilling rig.

5. The method of claim 4, wherein the logging is conducted in all wellbores via a wireline logging tool.

6. The method of claim 4, further comprising:

casing the first wellbore after drilling the second wellbore and before drilling the third wellbore; and casing the second wellbore after drilling the third wellbore.

7. A method of logging at least one wellbore, the method comprising the steps of:

drilling a first wellbore at a first location to a depth using a drilling rig;

after drilling the first wellbore, skidding the drilling rig to a second location;

drilling a second wellbore at the second location to a depth using the drilling rig; and while the second wellbore is being drilled, logging the first wellbore using the drilling rig.

8. The method of claim 7, wherein the logging of the first wellbore occurs off line while the second wellbore is being drilled.

9. The method of claim 8, wherein the logging of the first wellbore is conducted via a wireline logging tool.

10. The method of claim 7, wherein the logging of the first wellbore comprises an under-rig-floor open-hole logging operation.

11. The method of claim 7, further comprising:

after drilling the second wellbore, skidding the drilling rig to the first wellbore for casing of the first wellbore; and casing the first wellbore.

12. The method of claim 11, further comprising:

after casing the first wellbore, skidding the drilling rig to a third location;

drilling a third wellbore at the third location using the drilling rig; and while the third wellbore is being drilled, logging the second wellbore using the drilling rig.

13. The method of claim 12, further comprising:

after drilling the third wellbore, skidding the drilling rig to the second wellbore for casing of the second wellbore; and casing the second wellbore.

14. The method of claim 12, wherein the logging of the second wellbore is conducted via a wireline logging tool.

15. The method of claim 12, wherein the logging of the second wellbore comprises an under-rig-floor open-hole logging operation.

* * * * *